United States Patent [19]

Remington et al.

[11] Patent Number: 4,535,897

[45] Date of Patent: Aug. 20, 1985

[54] TOOL HANDLING AND TRANSPORTATION SYSTEM

[75] Inventors: John L. Remington, Coplay; Harry W. Seidel, Mertztown, both of Pa.

[73] Assignee: The Stanley Works, New Britain, Conn.

[21] Appl. No.: 529,728

[22] Filed: Sep. 6, 1983

[51] Int. Cl.[3] ..... A47F 7/00

[52] U.S. Cl. ..... 211/70.6; 280/47.34; 211/74

[58] Field of Search ..... 211/74, 70.6; 224/273; 280/47.34, 771, 91, 781, 783

[56] References Cited

U.S. PATENT DOCUMENTS

| | | | |
|---|---|---|---|
| D. 99,541 | 5/1936 | Dean | 211/60 T X |
| 3,179,255 | 4/1965 | DéCaccia | 211/60 T |
| 3,233,804 | 2/1966 | Dahm | 211/74 X |
| 3,351,210 | 11/1967 | Murcott | 211/74 |
| 3,893,739 | 7/1975 | Bernard | 211/74 X |
| 4,119,044 | 10/1978 | Hines | 280/47.34 X |
| 4,359,163 | 11/1982 | Ratti | 211/60 T |

FOREIGN PATENT DOCUMENTS 2619151 11/1977 Fed. Rep. of Germany .... 211/60 T

*Primary Examiner*—Ramon S. Britts
*Assistant Examiner*—Sarah A. Lechok
*Attorney, Agent, or Firm*—Woodcock, Washburn, Kurtz, Mackiewicz & Norris

[57] ABSTRACT

A tool storage and transportation system is described in which a single basic extrusion is used to support tools and for interaction with various types of support devices including vertically extending stationary shelves, drawers, tool carts or taxis, and the like. The basic extrusion can be cut to lengths sufficient to hold but a single tool or can be used in longer lengths as required. The basic extrusion can be used to interact with a tool taxi by addition of handle members at the end of the extrusion, so that the assembly with tools therein can be readily lifted in or out of the taxi as required. The basic extrusion has members running along its length which provide interaction at both sides for support between paired support bars or for fitting within storage brackets, in which the basic extrusion is held by the force of gravity.

6 Claims, 11 Drawing Figures

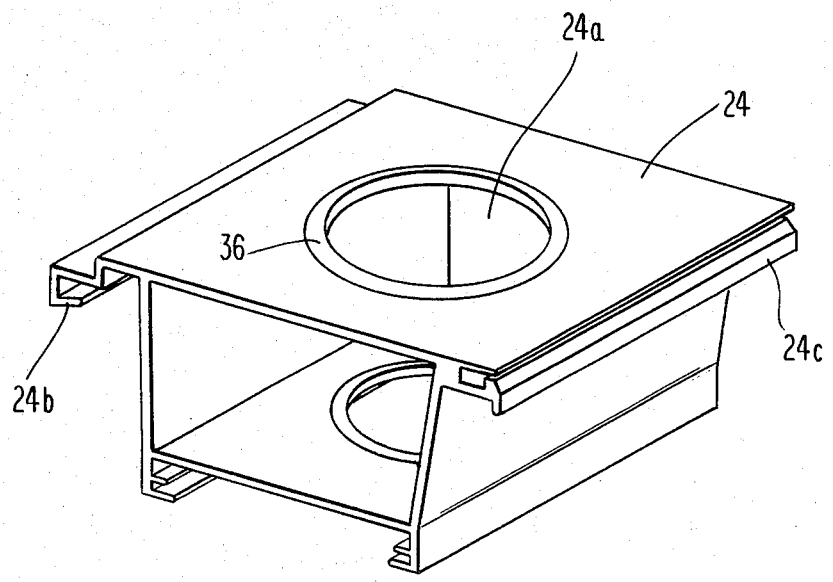
Fig. 6
Fig. 7
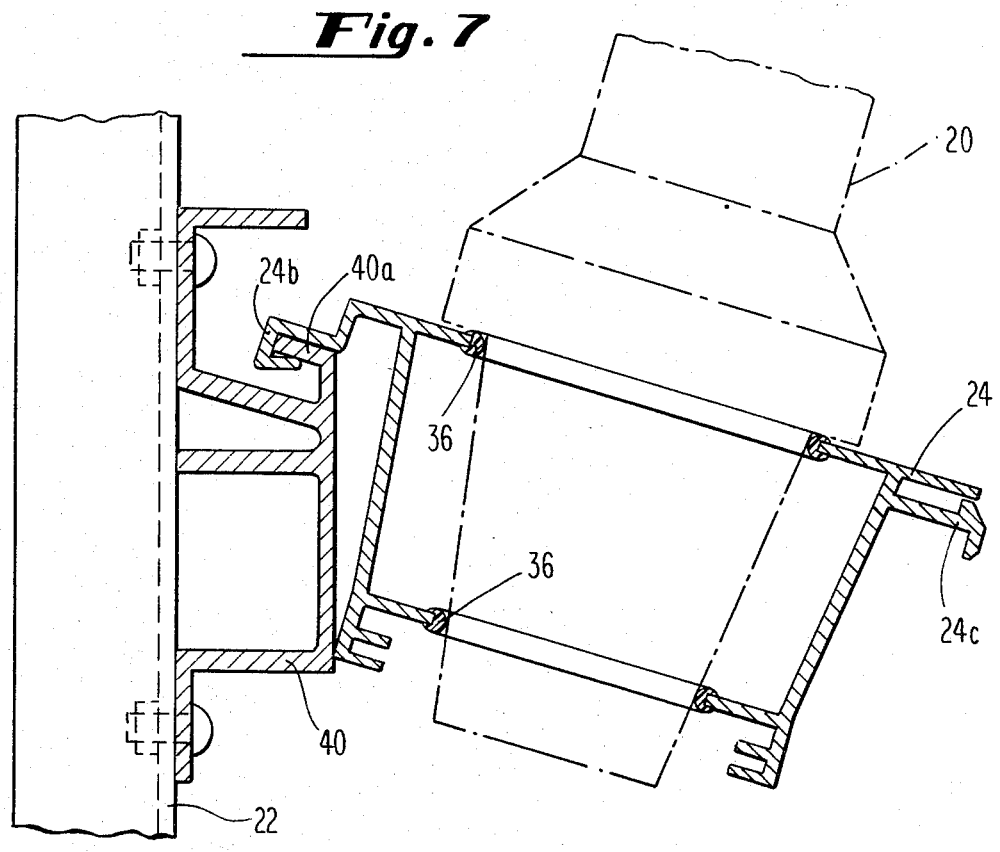

TOOL HANDLING AND TRANSPORTATION SYSTEM

FIELD OF THE INVENTION

This invention relates to tool handling and transportation systems. More particularly, the invention relates to a tool handling and transportation system in which a single aluminum extrusion is used for interaction with a wide variety of tool storage and transportation devices so that economy in the manufacture of such systems can be realized concommitantly with flexibility in choice of system components.

BACKGROUND OF THE INVENTION

The use of high performance numerically controlled and other sophisticated machine tools has increased in recent years, spurred by the inherent efficiencies realizable by use of these increasingly complex devices. However, it is well understood in the art that such machines are extremely expensive to purchase and therefore it is important that they be used to the highest degree of efficiency. Obviously, this requires that they be in production as much as possible; the set-up time, during which they are changed over from producing one type of parts to another, must thus be reduced as much as possible. To this end, it is usual to employ a particular group of workers in machine set-up, so that insofar as possible, the set-up of the machine for a given job can proceed concurrently with the operation of the machine on the previous job; that is, for example, whatever tools will be required to produce a given part are assembled, sharpened, adjusted, or manufactured as necessary prior to the previous job's conclusion. Then, when the previous job is concluded, the tools used to perform it can be removed from the machine and the new tools inserted. This is obviously more efficient than having the machine "down" for the entire time required to set up the tools, as well as that required to install them on the machine.

Typically, such set-up of machine tools will take place in a set-up area located separately from a tool storage area in which a large number of a wide variety of available tools, drill holders, chuckers, parts-holding collets and the like may be stored. A set-up worker will select from the storage area those tools and related parts that he requires and take them to his own work area for setting them up. When the previous job is then completed, he must carry these tools and other devices to the machine and install them. Clearly, it would be desirable to reduce the labor involved in the movement of tools insofar as possible, and furthermore to reduce the number of tool handling steps to a minimum.

The present inventors are aware of no devices which have been specifically adapted to this task. The prior art includes holders adapted for specific tools such as the very familiar accordion opening, twist drill boxes in which each drill has a correspondingly sized hole within which it is stored. One could install such an accordion drill box on a wheeled cart, thus forming a sort of tool transportation system. However, the present inventors are not aware of any integrated storage system which allows efficient handling and storage of a wide variety of tools and, in particular, one which would allow a number of tools to be transported at once from the transportation device to a workbench for set-up, to a machine for use or to a storage area for storage upon conclusion of an operation.

It is apparent then that there exists a need in the art for an improved tool handling and transportation system. Clearly to be successful, such a tool handling and transportation system would be efficient to manufacture and inexpensive to purchase, calling for a design utilizing a minimal number of custom manufactured components. The system would also desirably provide for a wide variety of tool handling and transportation uses so as not to unduly restrict its use. Finally, such a system to be successful would also serve to inherently reduce the number of tool handling steps required for a given number of tools moving between a given number of locations.

OBJECTS OF THE INVENTION

It is an object of the invention to provide an improved tool handling and transportation system.

It is a further object of the invention to provide a tool handling and transportation system in which a number of tools can be handled at once by an operator so as to save handling steps.

It is a further object of the invention to provide a modular tool handling and storage system in which the same holder can be used for a given tool both in a storage mode and in a transportation mode, so that the number of holders can be reduced to the number of tools.

It is a further object of the invention to provide an improved tool handling and transportation system which is designed so as to be readily manufacturable yet flexible in operational scheme.

SUMMARY OF THE INVENTION

The present invention achieves the needs of the art and objects of the invention mentioned above by provision of a tool handling and support system in which a single basic structure, typically an aluminum extrusion, is drilled or otherwise machined to become a holder of whatever machine tools or related devices are required to be stored. The same extrusion is adapted to interact with storage racks, with drawers, workbenches and the like and with a tool cart or "taxi" so that the entire taxi can simply be moved from one location to another by an operator, thus moving a plurality of tools at once, eliminating handling steps.

BRIEF DESCRIPTION OF THE DRAWINGS

The invention will be better understood if reference is made to the accompanying drawings, in which:

FIG. 6 is a perspective view of the basic tool holder;

FIG. 7 is a cross-sectional view taken along the line 7—7 of FIG. 2;

FIG. 8 shows a first embodiment of a way in which the tool holder according to the invention can be adapted for use within a drawer or the like;

FIG. 9 shows a second embodiment showing how the tool holder of the invention can be adapted for use within a drawer or the like;

DESCRIPTION OF THE PREFERRED EMBODIMENTS

Figure 1:
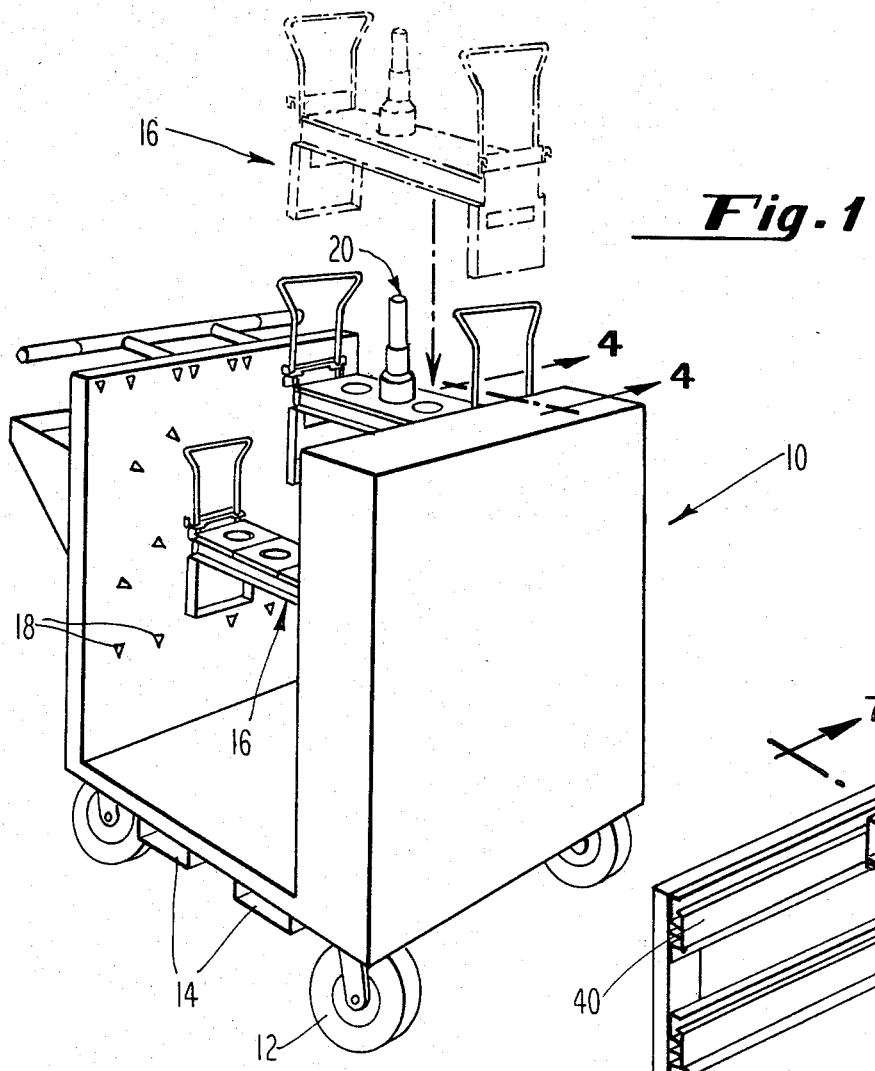
FIG. 1 is a perspective view of a tool cart or taxi showing how a plurality of tool storage holders with additional mounting structure can be fit therein for transportation.

FIG. 1 shows, as noted above, a perspective view of the tool cart or "taxi" which is used to carry racks of tools from one location to another. The taxi 10 preferably comprises a generally square cart having a plurality of casters 12 and means including slots 14 for insertion of forklift tines, so that a forklift can be used for rapid transit of the taxi over long distances as required. A number of tool racks 16 which will be discussed in detail below may be supported between two opposed side walls of the taxi 10 by interaction of ears formed on the tool holders 16 with spaced holes 18 formed in the opposed walls of the taxi. The details of the interaction are discussed below in connection with FIG. 4. As shown, a number of tool holders 16 can be provided and they are adapted, again as discussed below in connection with FIG. 4, for easy mounting and removal from the taxi 10 so that, for example, a taxi can be loaded with holders 16 full of tools 20, transported from one location to another and the entire holder containing a plurality of tools 20 can be lifted out and set on a workbench or the like. The arrangement is such that the tool holders are solidly supported while being readily demountable, not requiring, for example, undoing nuts and bolts or the like.

Figure 2:
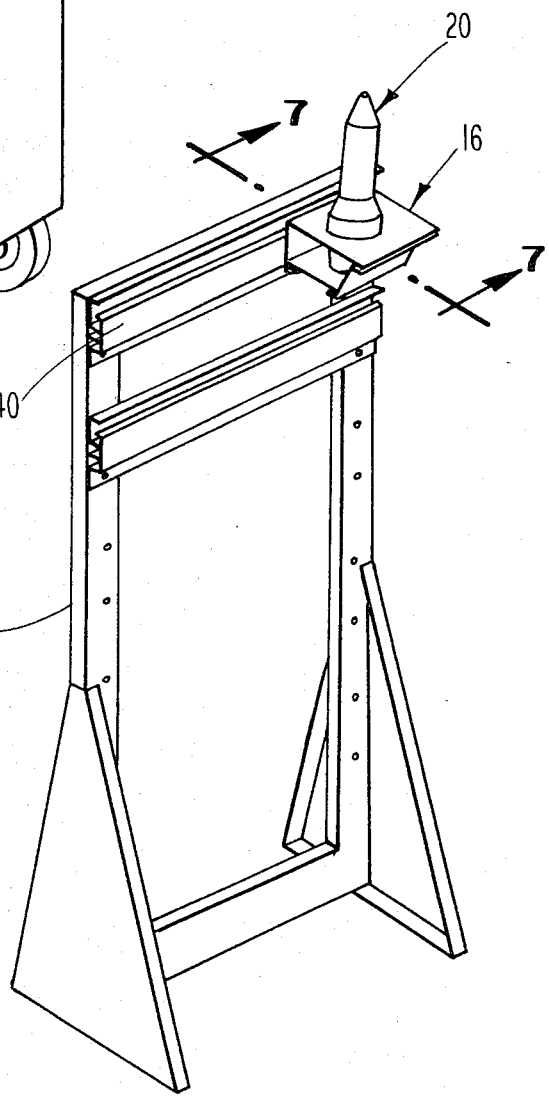
FIG. 2 shows a perspective view of a tool storage rack showing how the same basic tool holder can be used to store the tools in the rack.

As will be discussed in detail below, the basic holder unit is a modular aluminum extrusion having a specific cross-sectional shape designed for interaction with varying kinds of support structures, as required. For example, the holder 16 of FIG. 1 comprises a relatively long section of the aluminum extrusion which is mounted to support bars and end members comprising handles which provide the actual interaction between the holder 16 and the cart 10. The same aluminum extrusion can be used to mount the individual tool holders 16 onto an upright rack 22 as shown in FIG. 2. These can then be individually detached and removed as required. Again, in the preferred embodiment, no fasteners or other means are required to secure the holder 16 to the upright rack 22. This is discussed in detail below in connection with FIG. 7. Obviously, as shown in FIG. 2, a large number of holders 16 with tools 20 can be accommodated.

Figure 3:
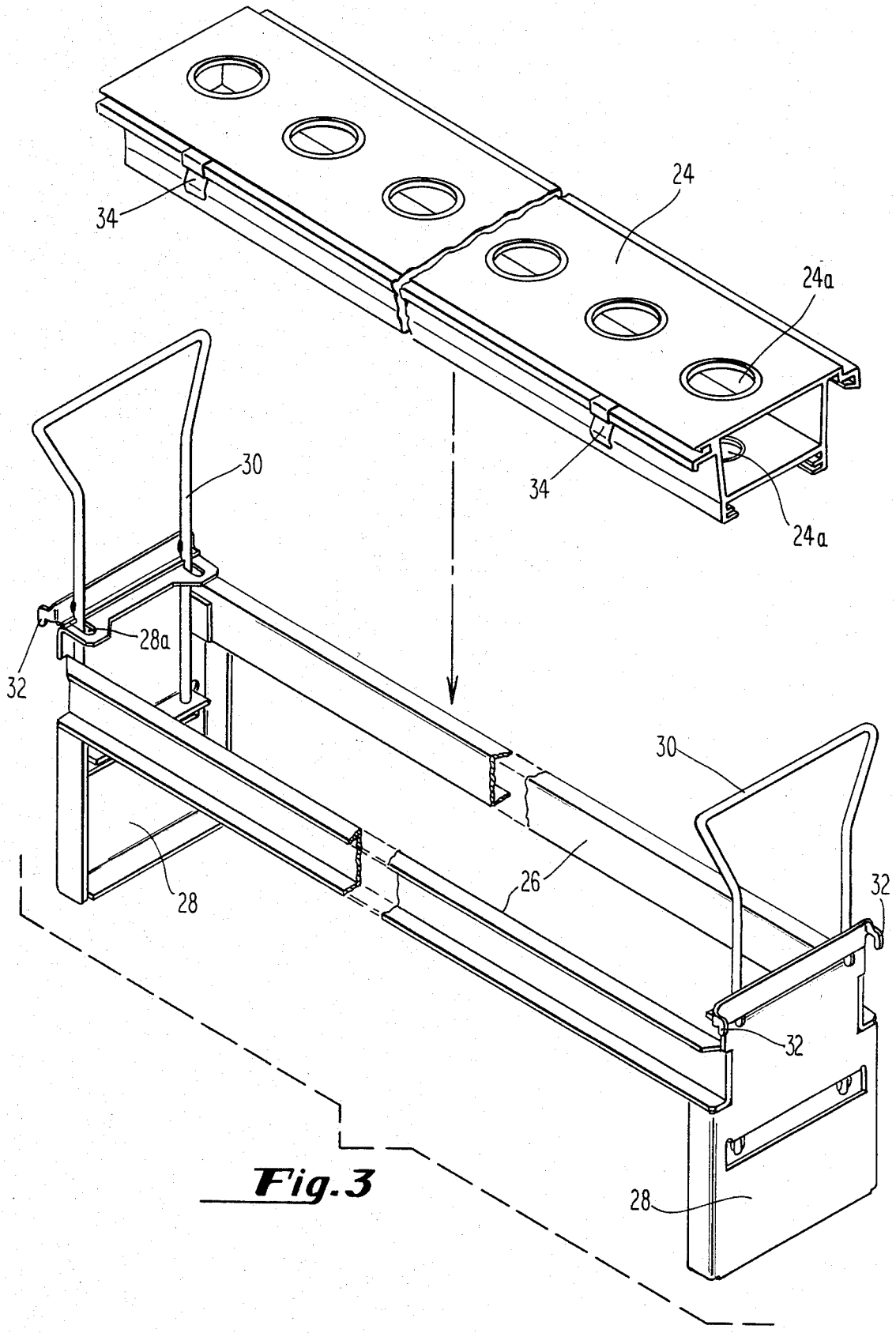
FIG. 3 is an exploded view showing how the basic tool holder part is assembled with a support rack including handles, for easy handling by the operator and for interaction with the tool taxi.

FIG. 3 shows details of how the basic holder assembly, that is, the unitary aluminum extrusion 24, can be adapted for storing within a tool taxi 10 as in FIG. 1; the same adapting structure allows the holder to sit upon a workbench or the like. The aluminum extrusion member 24 is drilled as at 24*a* to accommodate a number of tools. This task is simplified because tools are generally manufactured to include standardized mounting structure so that the same tools can be used on varying machines; this standardization of mounting structure enables the holes in the holder 24 to be sized to interact with the standard tools. Typically, for example, the tools now used in large machining centers have tapered shanks which are ideally suited for interaction with holes 24*a* formed in the aluminum extrusion.

The aluminum extrusion then is seated within paired opposing rails 26 of the support structure which actually carries it within the tool taxi and adapts it for sitting upon a workbench or the like. Attached to the two rails, e.g., by welding, are end members 28 which comprise handles 30 which not only provide a means for an operator to lift the entire assembly out of the cart and onto the workbench or the like, but also form the support members which suspend the assembly within the tool taxi 10. Various possibilities in the details of the end members 28 are possible, including variation of its overall height.

Figure 4:
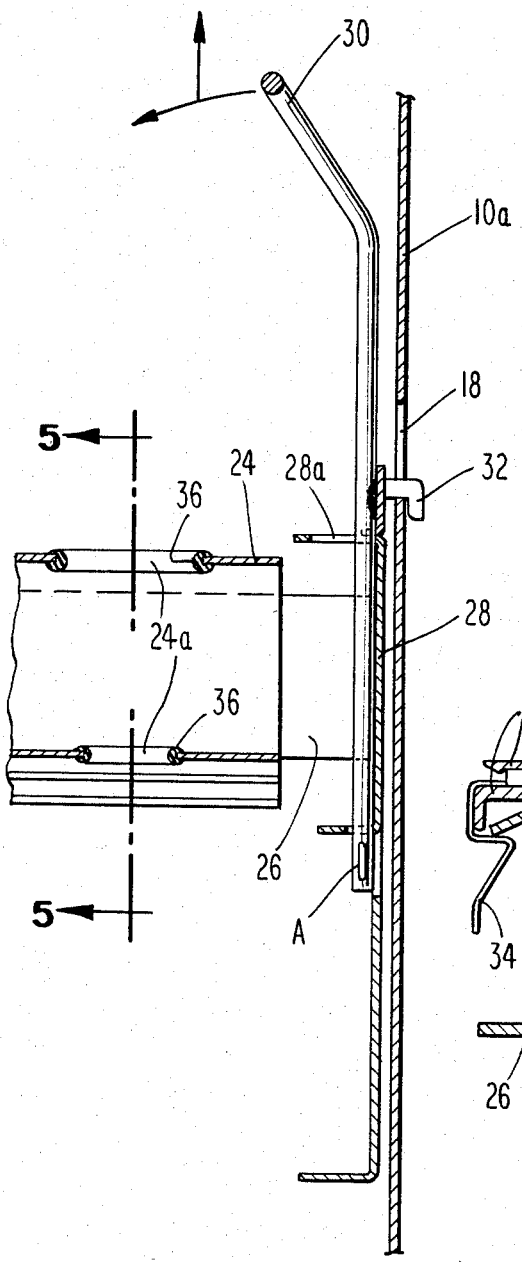
FIG. 4 is a cross-sectional view of the end of the tool holder support rack showing how it interacts with the tool taxi.

FIG. 4 shows how the handles 30 are welded to extending ear members 32 also shown in FIG. 3 which interact with the Y or V-shaped holes 18 formed in the opposing walls 10*a* of the tool taxi 10 as shown in FIG. 1. The handles 30 pivot about an axis indicated generally at A in FIG. 4; when the holder assembly is to be lifted out, one can pivot the handle 30 and ear 32 inwardly as shown by the arrow, so that the ear 32 is removed from the hole 18, allowing the entire assembly to be lifted out vertically. The fact that the assembly is not supported by resting on the bottoms of the end members allows the tools to extend beyond this level, which is frequently useful.

Figure 5:
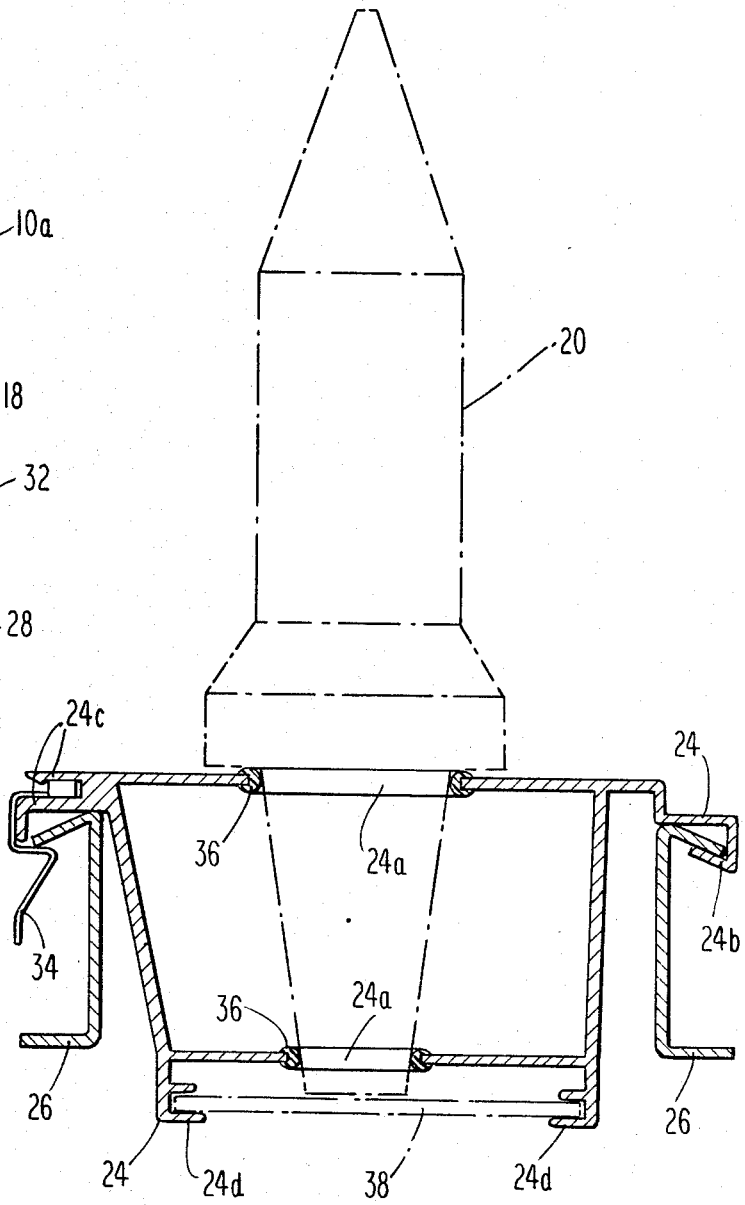
FIG. 5 is a cross-sectional view taken along the lines 5—5 of FIG. 4.

FIG. 5 shows a cross-section of the holder member 24 fitting within the opposed rails 26 and shows how a spring-clip 34, also shown in FIG. 3, can be used advantageously to retain the member 24 on the rails 26. As shown, one side of the extrusion 24 has a J-shaped detail 24*b* which fits over an L-shaped mating detail on the support rail 26, while the other side has a detail 24*c* to retain the spring-clip 34 and to provide a point against which it can exert force, thus holding the extrusion 24 with respect to the side rails 26. Preferably, the J-shaped detail 24*b* makes an interference fit with the L-shaped detail of the support rail 26 so that when the holder 24 is in the position shown, sufficient friction exists therebetween that the holder 24 does not slide with respect to the support rails 26. The tool shown in phantom in FIG. 5 is of a generally common shape, having a tapered shank. This can fit within two resilient grommets 36 molded to fit within the holes 24*a* formed in the aluminum extrusion. The same grommets 36 are, of course, shown in FIG. 4. An optional bottom member 38 shown in phantom can be inserted between flanges 24*d*, for example, to retain straight-shanked tools or the like; this member 38 could be a simple sheet of metal.

FIG. 6 shows a single basic tool holder member 24 which, as shown, is provided with a detail 24*b* for fitting together with one side rail as shown in FIG. 5, and a detail 24*c* for retaining a spring-clip 34, as also shown in FIG. 5. It will be apparent to those skilled in the art that this single extrusion 24 can be manufactured as a stock product and then be cut, drilled and otherwise machined as necessary to adapt it to the storage of a wide variety of tools. For example, holes 24*a* of differing size can be bored as shown in FIG. 6 to adapt the basic unit for the mounting of tapered shank tools 20 as shown in FIG. 5. Alternatively, numerous other schemes can be devised. Spring clips 34 as in FIG. 5 would also be used in conjunction with the holder 24 of FIG. 6.

The J-shaped detail 24*b* shown in FIG. 6 can also be used to mount the basic tool holder 24 on a second mounting structure as shown in FIG. 7. For example, an upright member 22 can have mounted thereon a cross-wise extending member 40 provided with a flange 40*a* for interacting with the detail 24*b* of the basic holder extrusion 24 so that individual or longer portions of the basic extrusion 24 can be supported by the upright member 22, as in, for example, a storage area or the like.

Figure 8:
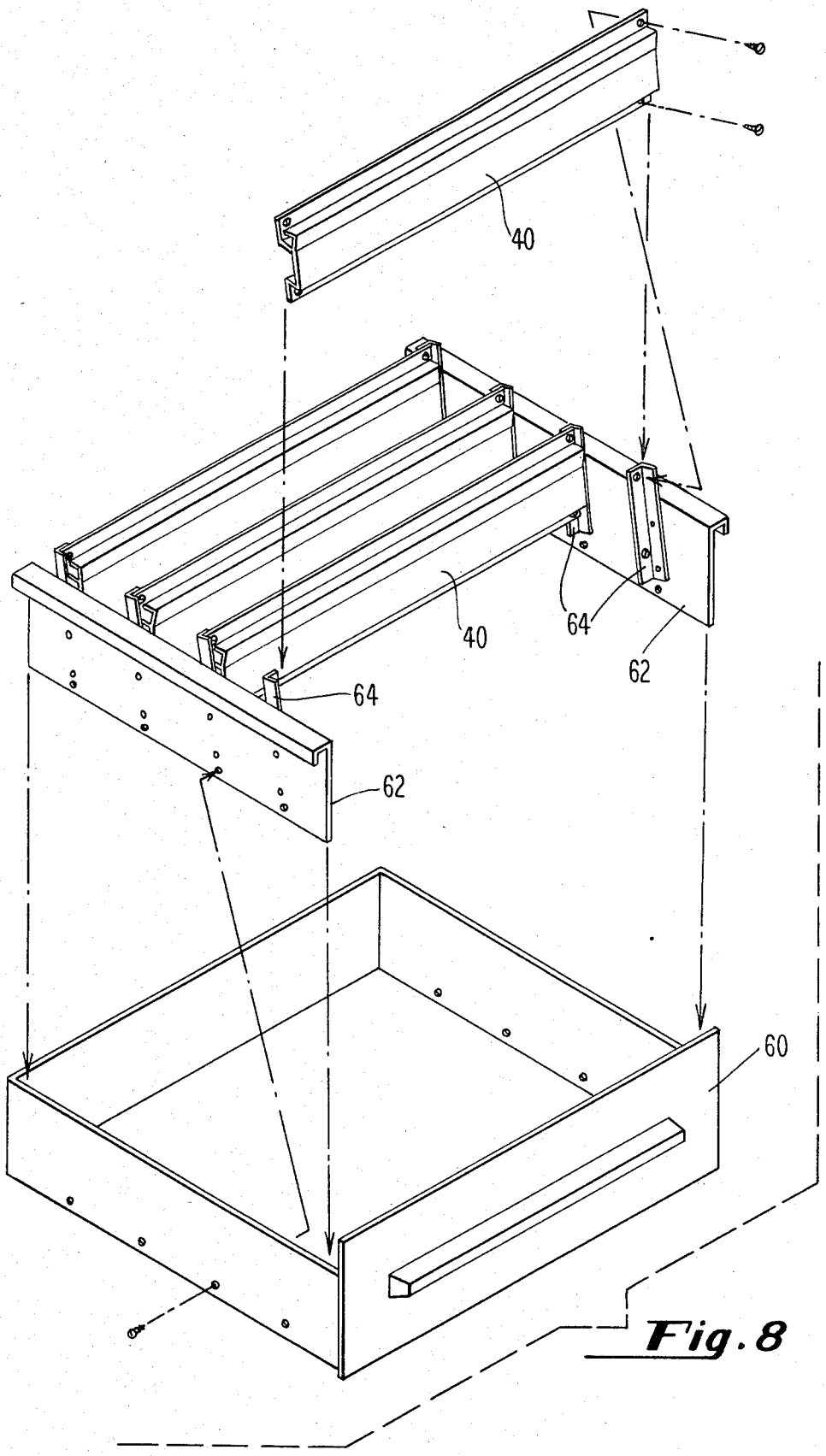

It will also be appreciated by those skilled in the art that it would be desirable to provide a way in which the tool holder of the invention can also be used to store tools within a drawer or the like. Clearly the assembly of holders 24 with end members 28 and handles 30 as in FIG. 3 can interact with slots formed in the walls of a drawer, as it does with the tool taxi. In this way the tools can extend below the bottoms of the end members 28 without interference with the bottom of the drawer. Alernatively, the tool holders can be mounted, for example, in a first drawer as shown in FIG. 8, in which a plurality of the members 40 which are used to support tool holders 24 according to the invention on the upright rack of FIGS. 2 and 7 are mounted cross-wise in a drawer 60. This can be accomplished readily by providing drawer side liners 62 and angle brackets 64 which will typically be drilled to interact respectively with the drawer side liners 62 and the members 40. As shown in FIG. 7, the members 40 are provided with L-shaped details to interact with the J-shaped detail 24*b* of the basic tool holder 24 according to the invention. In this way, the individual or longer tool holders 24 can be held by the force of gravity within the drawer 60 for storage within a conventional cabinet or the like.

Figure 9:
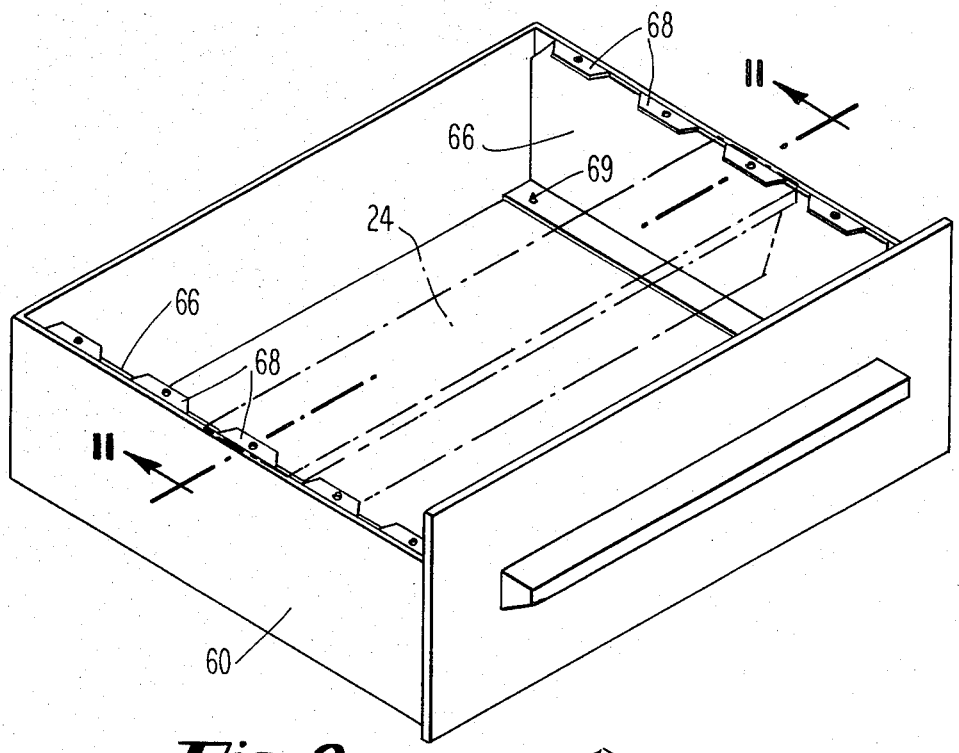
Figure 10:
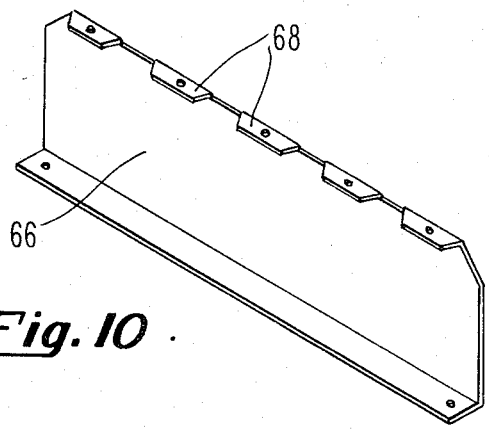
FIG. 10 shows a perspective view of a drawer side structure used in the embodiment of FIG. 9.
Figure 11:
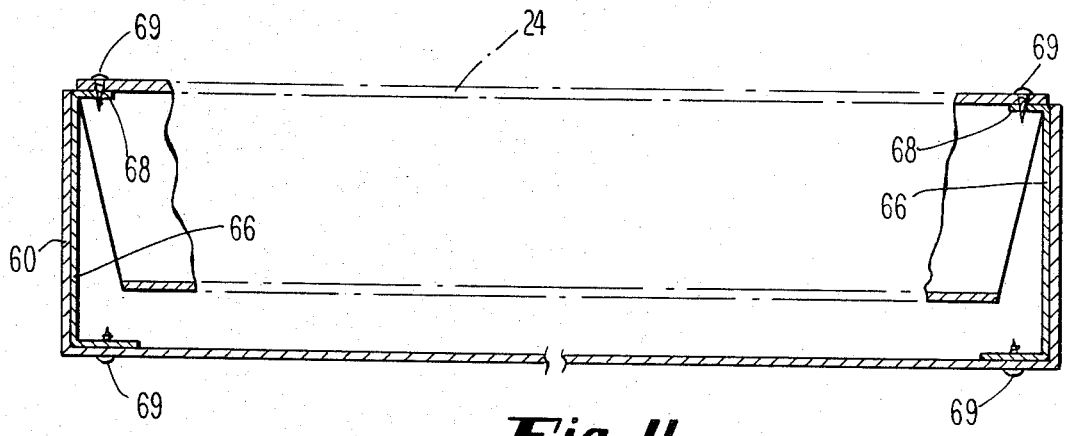
FIG. 11 shows a cross-section taken along the line 11—11 of FIG. 9.

FIGS. 9–11 show details of another method of mounting the tool holder according to the invention in a drawer 60. In this case the drawer sides 66 are provided with a number of bent over tabs 68 to which can be mounted tool holders 24 according to the invention can be mounted directly, e.g., as shown in phantom at 24 of FIG. 9. Here, of course, full-length holders 24 must be used; in the embodiment of FIG. 8, shorter sections of the basic holder can be employed. As shown in cross-section in FIG. 11, the lower portions of the basic tool holder extrusion 24 is cut away so as not to interfere with the bent over tab 68. As shown in FIG. 10, the entire assembly can be made by means of sheet metal screws 69 as shown in FIG. 11.

In this way, the single extrusion 24 is adapted for storage in vertical racks or in drawers, for use in transportation, and for sitting on a workbench to enable set-up of tools. Other uses of the basic extrusion in connection with the tool storage and transportation system can no doubt be devised by those skilled in the art.

Typically, the basic holder 24 as well as, possibly, the cross-wise member 40, will be extruded of aluminum, which is easily accomplished by well known techniques. By comparison, the side rails 26, the end members 28, the handles 30, and ear members 32 are all readily manufacturable from common steel stock. The spring-clip members 34 are of conventional spring steel material.

It will be appreciated by those skilled in the art that the basic design of the aluminum extrusion 24 which forms the basic tool holder member is such that it is readily adaptable to the wide variety of uses shown, as well as others not specifically described, which are nevertheless within the scope of the invention. Being provided with two differing details 24*b* and 24*c* as perhaps most clearly shown in FIG. 6, enables the device to be secured by its own weight under the force of gravity from a simple L-shaped support member as in 40 of FIGS. 7 and 8, while the shape of the detail 24*c* permits interaction with the spring-clips so that the holder 24 can be easily but releasably affixed to the side members 26 by simple spring-clips 34. Finally, provision of double opposed grooves as at 24*d* also shown in FIG. 5 allows the use of the extra bottom plate member 38 where this might be useful. In this way, the single extrusion can be made to serve a variety of purposes so that its manufacture becomes increasingly cost-effective, as opposed to a design in which a number of different tool holders were used for different purposes. Moreover, if the latter course was adapted, one would have to individually move tools from tool holders of one type to tool holders of another type, e.g., if it were desired to transfer the tool from a storage rack or drawer to a transportation cart. According to the present invention, however, the basic holder can be moved, together with any tools it might contain from, for example, a set-up area to a tool taxi for transport to a machining center, thus greatly simplifying the storage and transportation of tools in accordance with the needs of the art and objects of the invention mentioned above.

We claim:

1. An integrated tool storage and transportation system comprising a tool transportation means, a tool storage means, and an elongated tool holder member, in which said tool holder member is adapted for engagement for support by both said tool transportation means and said tool storage means, wherein said tool holder member comprises at its ends means adapted for mating with said tool transportation means, wherein said means adapted for mating with said tool transportation means comprised by said tool holder member at the ends thereof comprises pivoted handle means adapted for releasable engagement with said tool transportation means, said pivoted handle means comprising hook means for resting in slots formed in said transportation means, such that said handle means may be pivoted to move said hook means with respect to said slot means, in order to permit removal of said tool holder member from said transportation means.

2. The system of claim 1 wherein said means for supporting said tool holder along the length thereof comprises a longitudinally extending J-shaped member adapted to have an L-shaped support member fit therewithin, said L-shaped member being affixed to said support member for supporting said tool holder structure.

3. The system of claim 2 wherein the fit of said J-shaped member and said L-shaped member is sufficiently close that substantial frictional resistance to longitudinal sliding of said holder with respect to said support member exists therebetween.

4. The system of claim 1 wherein a unitary aluminum extrusion forms said tool holder structure whereby said extrusion can be adapted for supporting of various types of tools therewithin and for being supported by a variety of support structures.

5. The system of claim 4 wherein said basic extrusion is adapted for holding of various types of tools by providing means on said basic extrusion adapted to interact with the portions of said tools which are used to mount said tools to machinery in machining operations.

6. The system of claim 1 wherein said tool storage means supports said tool holder member by interaction therewith along its length.

* * * * *